United States Patent [19]

Jakob

[11] 4,060,976

[45] Dec. 6, 1977

[54] CALENDAR RING DRIVING WHEEL FOR TIMEPIECES

[75] Inventor: Edwin Jakob, Grenchen, Switzerland

[73] Assignee: ETA A.G. Ebauches-Fabrik, Switzerland

[21] Appl. No.: 685,130

[22] Filed: May 10, 1976

[30] Foreign Application Priority Data

May 16, 1975 Switzerland ..... 6345/75

[51] Int. Cl.[2] ..... G04B 19/24; G04B 27/00

[52] U.S. Cl. ..... 58/58; 58/5; 58/85.5

[58] Field of Search ..... 58/4, 5, 58, 85.5, 63

[56] References Cited

U.S. PATENT DOCUMENTS

| | | | |
|---|---|---|---|
| 3,732,687 | 5/1973 | Miyasaka et al. | 58/58 |
| 3,744,237 | 7/1973 | Muto | 58/58 |
| 3,789,602 | 2/1974 | Nemoto | 58/58 |

*Primary Examiner*—E.S. Jackmon

*Attorney, Agent, or Firm*—Stevens, Davis, Miller & Mosher

[57] ABSTRACT

A timepiece having a toothed calendar ring and a driving wheel for advancing the calendar ring, wherein the driving wheel comprises a hub and a completely closed toothed rim having a driving tooth. The rim is connected to the hub by a resilient member so that the driving tooth makes way for a tooth of the calendar ring when the calendar ring is driven by means other than the driving wheel.

7 Claims, 2 Drawing Figures

CALENDAR RING DRIVING WHEEL FOR TIMEPIECES

Figure 1:
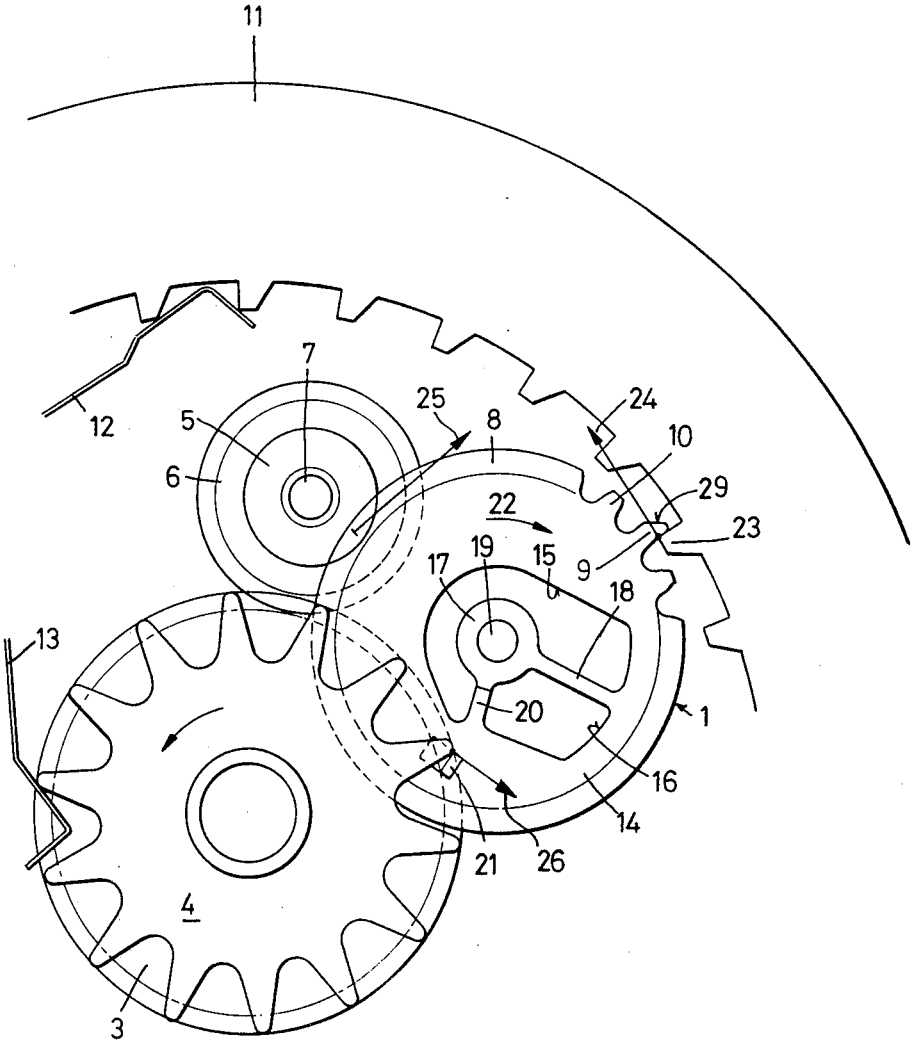

This invention relates to a driving wheel for advancing a toothed calendar ring of a timepiece, comprising a hub and a toothed rim having a driving tooth projecting radially beyond the rim for engaging the toothing of the calendar ring.

Timepieces having a calendar ring are already known in which the date can be corrected even when a driving tooth or finger for advancing the calendar ring is engaged in the inner toothing of the ring. This correction operation is made possible by designing the driving tooth in such a way that when the calendar ring is rotated by means other than the driving tooth itself, this tooth can give way radially towards the inside. A driving wheel having a driving tooth or finger designed in this manner is disclosed in U.S. Pat. No. 3,744,237. This known driving wheel is made in one piece and comprises an arcuate slot, coaxial with the pin on which the wheel is mounted, extending over approximately 180°. Near one end of the slot, the driving finger is disposed and the toothed rim of the driving wheel is broken so that the portion of the wheel separated from the rest of the wheel by the slot is resilient. At the inner edge of the driving finger there is a tangential projection serving, while the driving finger is advancing the calendar ring, as a stop against the inside of the tooth of the driving wheel adjacent to the driving tooth, the toothed rim being broken between these two teeth. If the calendar ring is advanced when the driving finger is situated between two teeth of the calendar ring, the driving tooth can give way radially towards the inside owing to the resilience of the portion of the rim separated by the slot, so that it does not hinder the advance of the calendar ring.

The manufacture of this known driving wheel presents certain difficulties. It is generally customary to obtain such timepiece parts by blanking. In order to remove the burrs occurring during the blanking, the blanked driving wheels are placed in a tumbling-barrel for surface polishing. There they are tumbled about, and it often happens that the separated portions of the toothed rims get caught in the slots of other driving wheels, thus forming rather long chains of interconnected driving wheels in some cases. The same effect is also produced when vibrators are used for conveying the individual parts to the place of assembly, or when a large number of such driving wheels are transported in a box. It takes a great deal of time to separate the tangled driving wheels, which are often damaged beyond use during this procedure.

Moreover, these known driving wheels are not suitable for advancing a day-disc because the driver for rotating such a disc would have to be disposed precisely at a location on the toothed rim which is weakened by the slot, whereby the risk of breakage would be considerably increased.

It is an object of this invention to provide a driving wheel of the aforementioned kind which eliminates the possibility of tangling during the polishing operation and/or during transportation.

A further object of the invention is to provide a driving wheel which can easily be adapted for advancing a day-disc.

To this end, the driving wheel according to the present invention further comprises means for connecting the hub to the rim in such a way that the rim and the hub are concentric upon advancement of the calendar ring by the driving tooth and that the rim together with the driving tooth is displaced relative to the hub upon advancement of the calendar ring by means other than the driving tooth, the rim constantly retaining the same geometric shape.

Figure 2:
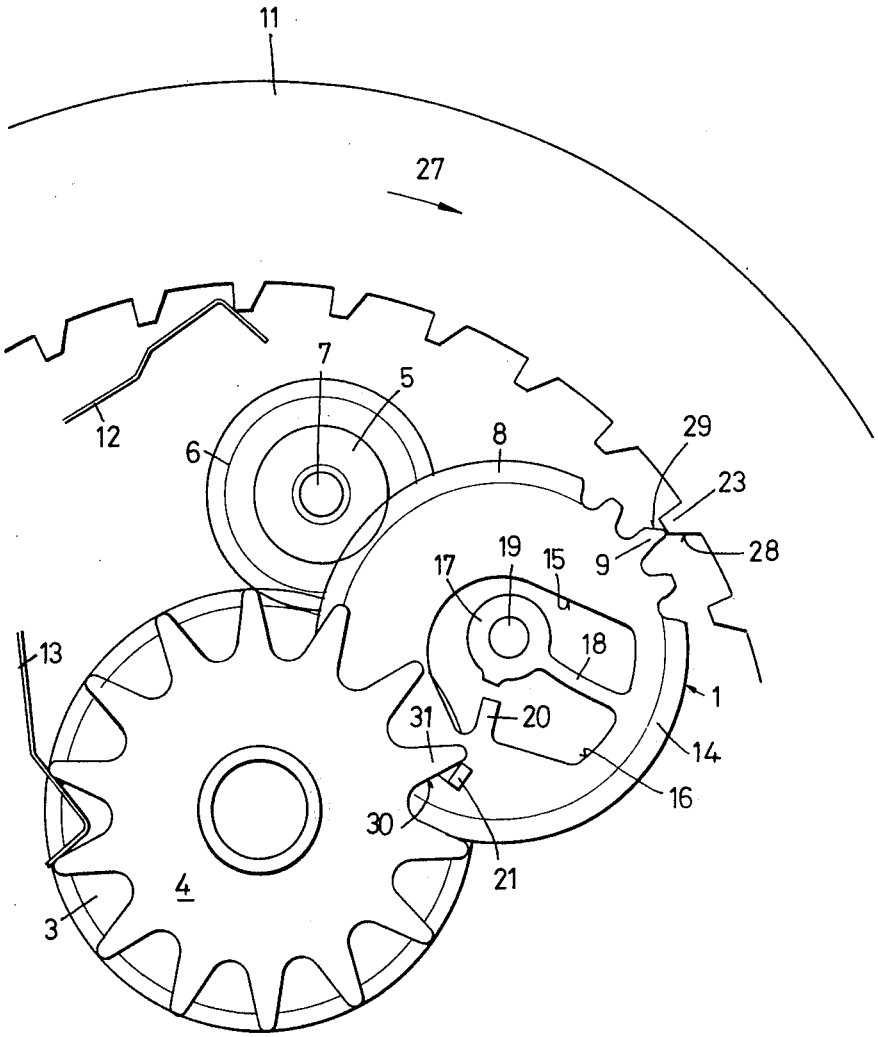

A preferred embodiment of the invention will now be described in detail with reference to the accompanying drawings, in which:

FIG. 1 is a plan view of part of a timepiece movement having a driving wheel, the driving tooth of which is driving a calendar ring, shown only in part, and FIG. 2 is a plan view of the same portion of the timepiece movement as in FIG. 1, but showing the driving tooth in its yielding position.

In FIG. 1, only those parts of a timepiece movement directly cooperating with a driving wheel 1 are shown. Mounted for free rotation on an hour-wheel 3 is a star-wheel 4 for advancing a day-disc (not shown). The driving wheel 1 is driven by the hour-wheel 3 via a wheel 6 and a pinion 5 mounted on an arbor 7. The wheel 6 engages the toothing of the hour-wheel 3, and the pinion 5 rigidly secured to the wheel 6 meshes with a toothing 8 of the driving wheel 1. The transmission ratio is such that the driving wheel 1 rotates once when the hour-wheel 3 rotates 24 times. One tooth of the driving wheel 1 takes the form of a driving tooth 9 projecting radially beyond the other teeth of the driving wheel 1 so as to engage the inner toothing of a calendar ring 11, shown only in part.

A first jumper 12 holds the calendar ring 11 and a second jumper 13 the star-wheel 4 in specific positions between two advancing operations.

The driving wheel 1 comprises a completely closed rim 14 and two cut-out portions 15 and 16 defining a hub 17 which is connected to the rim 14 by a crossing or spoke 18. Passing through the hub 17 is an arbor 19 about which the driving wheel 1 can rotate. The spoke 18 is disposed at an angle to that radius along which the driving tooth 9 extends, preferably forming an angle of 60° with that radius. Extending radially towards the hub 17, at an angle to the spoke 18, is a stop member 20 joined to the rim 14. In the normal operating state and during the advancement of the calendar ring 11 by the driving tooth 9, the inner end of the stop member 20 is in contact with the hub 17. The stop member 20 might also be joined to the hub 17, in which case its outer end would rest against the rim 14. The abutting faces of the stop member 20 and the hub 17 preferably run tangentially. In the vicinity of the location where the stop member 20 is joined to the rim 14 there is a driver 21, projecting axially from the driving wheel 1, which driver cooperates with the toothing of the star-wheel 4. The drive 21 is partially blanked out of the driving wheel 1 and bent at a right angle.

In FIG. 1, the driving wheel 1 is situated in precisely that position in which the driving tooth 9 is advancing the calendar ring 11 and the driver 21 is advancing the star-wheel 4 and hence the day-disc (not shown). The hour-wheel 3 rotates clockwise, and the wheel-and-pinion 5, 6 driven thereby rotates counterclockwise; therefore, the driving wheel 1 is rotated in the direction indicated by an arrow 22, i.e., also clockwise. The preferably radially oriented leading flank of the driving tooth 9, which rests against the preferably also radially oriented trailing flank of a tooth 23 of the calendar ring 11, exerts a torque upon the calendar ring 11 in opposition to the return force of the jumper 12, the force of reaction with respect to the driving wheel 1 acting tangentially upon the driving tooth 9, as indicated by an arrow 24. The force exerted upon the driving wheel 1 by the pinion 5 is indicated by an arrow 25. A third force, indicated by an arrow 26, acts upon the driver 21 of the driving wheel 1. Because the rim 14 is rigid, a resultant action can be determined from these three forces acting upon the driving wheel 1. The stop member 20 is preferably disposed in such a way that it extends towards the center of the driving wheel 1 substantially parallel to the direction of the resultant when the resultant is at its maximum. Because of the presence of the stop member 20, the driving wheel 1 works during the advancing operation virtually as a rigid driving wheel, even though the hub 17 is joined to the rim 14 only by the spoke 18. The fact that the driving wheel 1 behaves as a completely rigid driving wheel during the advancing operation influences the accuracy of advance so that the calendar ring and the day-disc are advanced during precisely determined intervals.

In timepiece movements having no day-disc, only two forces act upon the driving wheel 1. The direction of the resultant is not the same as described above. This fact must be taken into account in positioning the stop member 20. Accordingly, the stop member 20 would have to be disposed in a counterclockwise-shifted position as compared with FIG. 1. In both cases, i.e., with two or with three forces acting, the resultant is directed outwardly from the hub 17, so that the stop member 20 performs its function. The spoke 18 is thereby relieved and does not buckle.

When the date is corrected, the calendar ring 11 is advanced in the direction indicated by an arrow 27 (FIG. 2), not by the driving tooth 9, but by correction means (not shown). FIG. 2 illustrates a moment during the correction operation. Since, during that operation, the rotation of the calendar ring 11 is very fast as compared with that of the driving wheel 1, it may be assumed that the hour-wheel 3 and the wheel-and-pinion 5, 6 are stationary during the correction.

When the calendar ring 11 is rotated, the leading flank 28 of the tooth 23 of the calendar ring strikes the trailing flank 29 of the driving tooth 9. Because these two flanks are positioned at an angle to the corresponding radius, a force acts upon the driving tooth 9 which is transmitted to the rigid rim 14. Because the toothed rim 14 is meshing with the pinion 5, the entire rim 14 is pivoted clockwise by the aforementioned force about the point of engagement of the toothing of the pinion 5 and the toothing 8 of the rim 14. The spoke 18 then resiliently deflects because the hub 17 is mounted on the stationary arbor 19 and cannot give way.

The driver 21 secured to the rim 14 is likewise displaced by a short distance. Since, however, the direction of movement of the driver 21 is approximately parallel to the trailing flank 30 of a tooth 31 of the star-wheel 4, the star-wheel 4 is practically not moved.

FIG. 2 illustrates the maximum deflection of the driving tooth 9. The tips of the driving tooth 9 and the tooth 23 of the calendar ring 11 are pressed against one another by the resilient action of the spoke 18. If the tooth 23 is rotated further in the direction of the arrow 27, the rim 14, and thus the driving tooth 9, returns to its starting position.

In a timepiece movement comprising the driving wheel described above, a calendar correction may be made at any time, particularly even when the driving tooth is within the range of the inner toothing of the calendar ring. During the normal advancement of the calendar ring by the driving wheel, the latter works exactly like a rigid driving wheel, whereby the calendar ring and, as the case may be, the day-disc are advanced at precisely determined instants.

In a timepiece equipped with the driving wheel in question, the date can also be corrected by turning the hands backward, in which case the driving wheel 1 is likewise rotated counterclockwise with respect to the calendar ring 11. As a result, the driving tooth 9 gives way towards the center of the timepiece and jumps over the tooth 23 of the calendar ring 11.

No difficulties arise during the manufacture of driving wheels as described above, i.e., they cannot become entangled during de-burring and polishing in a tumbling-barrel, in the conveyor device, or during transportation, because the rim 14 is not broken but completely closed.

What is claimed is:

1. A driving wheel for advancing a toothed calendar ring of a timepiece, comprising a hub and a toothed rim having a driving tooth projecting radially beyond said rim for engaging the toothing of said calendar ring, further comprising means for connecting said hub to said rim in such a way that said rim and said hub are concentric upon advancement of said calendar ring by said driving tooth and that said rim together with said driving tooth is displaced relative to said hub upon advancement of said calendar ring by means other than said driving tooth, said rim constantly retaining the same geometric shape.

2. A driving wheel in accordance with claim 1, wherein said means for connecting comprises a spoke joined to said hub and to said rim, said spoke being longitudinally disposed at an angle to the radius along which said driving tooth extends.

3. A driving wheel in accordance with claim 2, wherein said means for connecting further comprise a stop member disposed between said rim and said hub at an angle to said spoke for preventing said driving tooth from yielding during advancement of said calendar ring by said driving tooth.

4. A driving wheel in accordance with claim 3, wherein said stop member is joined to said rim and has a free end resting against said hub when said rim and said hub are concentric.

5. A driving wheel in accordance with claim 3, wherein said stop member is joined to said hub and has a free end resting against said rrim when said rim and said hub are concentric.

6. A driving wheel in accordance with claim 3, wherein said timepiece further comprises a star-wheel, said driving wheel further comprising an axially projecting driver disposed on said rim in the vicinity of said stop member for advancing said star-wheel.

7. A driving wheel in accordance with claim 1, wherein said driving tooth comprises a radially oriented leading flank operative during said advancing and a trailing flank running at an angle to said leading flank.

* * * * *